US007215895B2

(12) United States Patent
Park

(10) Patent No.: US 7,215,895 B2
(45) Date of Patent: May 8, 2007

(54) METHOD AND APPARATUS FOR ADJUSTING PRINTING VELOCITY IN DIGITAL OFFICE DEVICE

(75) Inventor: Kwang-sung Park, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 145 days.

(21) Appl. No.: 11/110,820

(22) Filed: Apr. 21, 2005

(65) Prior Publication Data

US 2005/0254844 A1 Nov. 17, 2005

(30) Foreign Application Priority Data

May 12, 2004 (KR) ..... 10-2004-0033307

(51) Int. Cl.
*G03G 15/00* (2006.01)
*G03G 21/00* (2006.01)

(52) U.S. Cl. ..... 399/44; 399/16

(58) Field of Classification Search ..... 399/44, 399/43, 16, 75, 67, 68, 320
See application file for complete search history.

(56) References Cited

U.S. PATENT DOCUMENTS 6,542,703 B1 * 4/2003 Jung ..... 399/44
2003/0002881 A1 * 1/2003 Hirose et al. ..... 399/44
2004/0126124 A1 * 7/2004 Inoue et al. ..... 399/44
2004/0165897 A1 * 8/2004 Hooper et al. ..... 399/44
2005/0036798 A1 * 2/2005 Mochizuki ..... 399/44

FOREIGN PATENT DOCUMENTS

| | | |
|---|---|---|
| EP | 1 164 440 A1 * | 12/2001 |
| JP | 08-016043 | 1/1996 |
| JP | 09-190127 | 7/1997 |
| JP | 11-003000 | 1/1999 |
| JP | 11-157185 | 6/1999 |
| KR | 1020010028557 A | 4/2001 |
| KR | 1020010087912 A | 9/2001 |

* cited by examiner

*Primary Examiner*—Sophia S. Chen
(74) *Attorney, Agent, or Firm*—Roylance, Abrams, Berdo & Goodman, L.L.P.

(57) ABSTRACT

Method and apparatus for adjusting an image formation speed with respect to printing data transferred from a digital office device. To that end, an internal temperature and an operation environment of the digital office device are measured. The measured internal temperature and the operation environment are used to calculate a first threshold output sheet number. When the sheet number of the image formation with respect to the transferred printing data exceeds the first threshold output sheet number, the operation environment is used to adjust the image formation speed with respect to the printing data.

19 Claims, 4 Drawing Sheets

METHOD AND APPARATUS FOR ADJUSTING PRINTING VELOCITY IN DIGITAL OFFICE DEVICE

CROSS-REFERENCE TO RELATED APPLICATIONS

This application claims benefit under 35 U.S.C. § 119 from Korean Patent Application No. 2004-33307 filed on May 12, 2004 with the Korean Intellectual Property Office, the entire content of which is incorporated herein by reference.

BACKGROUND OF THE INVENTION

1. Field of the Invention

The present invention generally relates to a digital office device for performing copying, printing, scanning, and so forth. More particularly, the present invention relates to a method and a system for checking operating states of a digital office device to control its internal temperature.

2. Description of the Related Art

In general, examples of the digital office device include a copy machine, a printer, a scanner, a facsimile, and so forth. The digital office device performs printing of data received from its receiver unit on a printing sheet.

FIG. 1 illustrates a procedure of performing the printing operation in the printer, as an example of a function performed by digital office devices. Hereinafter, the procedure of performing the printing operation in the printer will be described in detail with reference to FIG. 1.

In a step S100, the printer determines whether printing data are received. The printer proceeds to a step S102 when it is determined that the printing data are received, and returns to the step S100 when it is determined that the printing data are not received.

In the step S102, the printer performs image formation on the received printing data in a conventional manner. A detailed description of performing the image formation is omitted. In a step S104, the printer measures its internal temperature. In a step S106, the printer compares the measured internal temperature with a predetermined value. The printer returns to the step S102 to continue the image formation when the measured internal temperature is determined to be lower than the predetermined value. However, the printer proceeds to a step S108 when the measured internal temperature is determined to be higher than the predetermined value upon the comparison. In the step S108, the printer stops the image formation on the printing data.

Stopping the image formation may prevent the internal temperature of the printer from drastically increasing. In other words, the image formation or an operation of a sheet feeding device may be stopped for the sake of system stability, which allows the internal temperature of the printer to be reduced.

In FIG. 1, the printer stops the image formation when the internal temperature measured by the printer exceeds the predetermined value. However, the printer may stop the image formation when the number of printing sheet with respect to the printing data for forming the image, which is measured by the printer, exceeds the predetermined value.

However, the method for stopping the image formation with respect to the printing data causes several problems. When the internal temperature of the printer exceeds the predetermined value, it cannot be known for how long the image formation should be stopped so that the internal temperature reduces to a specific temperature. Accordingly, when a user sets a specific stoppage time period in the printer, the printer stops the image formation for the set specific time period. In addition, the user sets the same specific time period regardless of operating environments of printers. As a result, there is a need for dealing with problems in the image formation device including the printer resulting from having such stopping arrangements.

SUMMARY OF THE INVENTION

It is therefore one aspect of the present invention to provide a method and a system for adjusting an image formation speed with respect to printing data in consideration of an operating environment of a digital office device.

It is another aspect of the present invention to provide a method and a system for adjusting an image formation speed with respect to printing data in consideration of various functions performed in a digital office device.

According to one aspect of the present invention, there is provided a method for adjusting an image formation speed with respect to printing data transferred from a digital office device, which comprises measuring an internal temperature and an operation environment of the digital office device; using the measured internal temperature and the operation environment to calculate a first threshold output sheet number; and adjusting the image formation speed with respect to the printing data using the operation environment when the sheet number of the image formation with respect to the transferred printing data exceeds the first threshold output sheet number.

According to another aspect of the present invention, there is provided an apparatus for adjusting an image formation speed with respect to printing data transferred from a digital office device, which comprises a temperature measuring unit for measuring an internal temperature of the digital office device; an operation environment detecting unit for measuring an operation environment of the digital office device; and a control unit for reading out a first threshold output sheet number corresponding to the measured internal temperature and the operation environment, and adjusting the image formation speed with respect to the printing data using the operation environment when the sheet number of image formation with respect to the transferred printing data exceeds the first threshold output sheet number.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE EMBODIMENTS

Hereinafter, embodiments of the present invention will be described in detail with reference to illustrative accompanying drawings.

Figure 1:
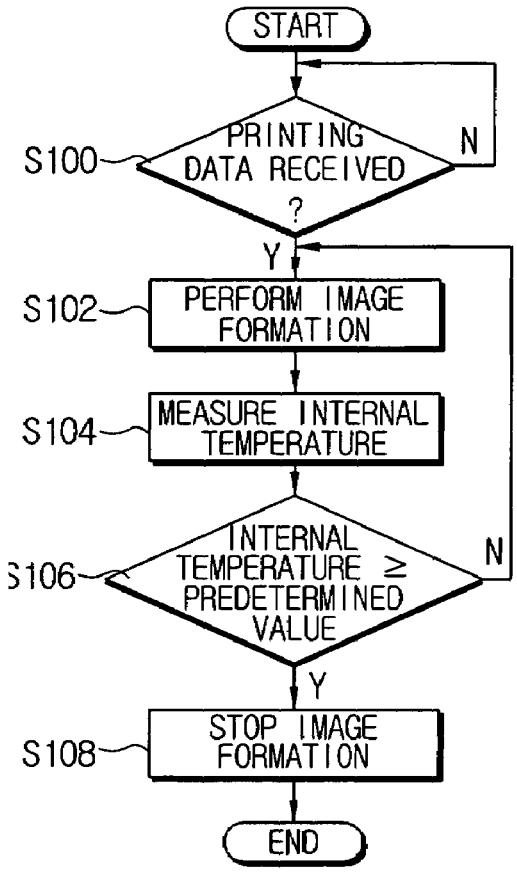
FIG. 1 (PRIOR ART)
FIG. 1 is a flowchart of general operations performed in the digital office device.
Figure 2:
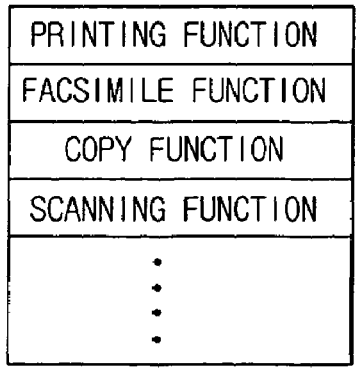
FIG. 2 is a view of functions performed in a multi-function digital office device according to an embodiment of the present invention.

FIG. 2 shows functions performed in a multi-function digital office device. In FIG. 2, the multi-function digital office device performs a printing function, a facsimile function, a copy function, a scanning function, and so forth. It is apparent that other functions may be included in the multi-function digital office device in addition to the above-mentioned functions. The multi-function digital office device experiences a greater internal temperature change when at least two tasks are performed than when one task is performed.

Figure 3:
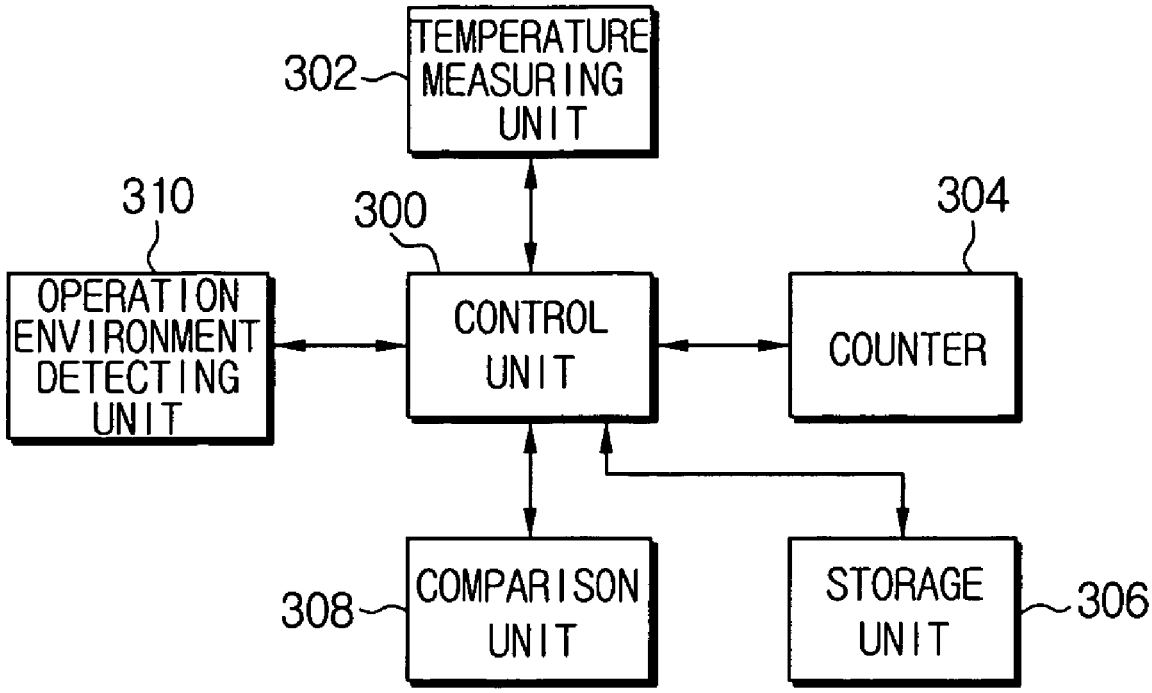
FIG. 3 is a block diagram of a digital office device according to an embodiment of the present invention.

FIG. 3 illustrates a configuration of the digital office device for performing one function according to an embodiment of the present invention. The digital office device includes a control unit 300, a temperature measuring unit 302, a counter 304, a storage unit 306, a comparison unit 308, and an operation environment detecting unit 310. Other components in addition to the above-mentioned components may be included in the digital office device, however, FIG. 3 illustrates essential components related to an embodiment of the present invention.

The temperature measuring unit 302 measures the internal temperature of the digital office device. The temperature measuring unit 302 measures the temperature of a unit for performing the image formation. In other words, the temperature of a fuser unit is measured when the digital office device is the printer. The temperature measuring unit 302 generally measures the temperature of a unit for performing the image formation, but is not limited thereto. In other words, any unit where the internal temperature of the digital office device may be measured may be included in an embodiment of the present invention.

The operation environment detecting unit 310 measures the environment state in which the digital office device is operating. The environment state that may be measured by the operation environment detecting unit 310 may include temperature, moisture, and so forth. The operation environment detecting unit 310 classifies temperatures that may be measured into at least two sections, and allocates the measured temperature to one of the at least two sections. In other words, the operation environment detecting unit 310 classifies the temperatures that may be measured into a low temperature, a room temperature, and a high temperature, and may allocate the measured temperature to one of the low temperature, the room temperature, and the high temperature. The user may increase the number of temperature sections that may be classified by the operation environment detecting unit 310. The operation environment detecting unit 310 also classifies moistures that may be measured into at least two sections as is done with the temperature, and allocates the measured moisture to any one of the at least two sections. In other words, the operation environment detecting unit 310 classifies the moistures that may be measured into low moisture, room moisture, and high moisture, and may allocate the measured moisture to one of the low moisture, the room moisture, and the high moisture. The operation environment detecting unit 310 transfers the measured information to the control unit 300.

The counter 304 measures the number of printing sheet that is consecutively printed for the image formation in the digital office device. The counter 304 transfers the information with respect to the measured number of printing sheet to the control unit 300 in real-time.

The storage unit 306 stores information required by the digital office device. In particular, the storage unit 306 stores a first threshold output sheet number and a second threshold output sheet number according to an embodiment of the present invention. The first threshold output sheet number is for performing an operation by means of a fuzzy inference in an embodiment of the present invention. The second threshold output sheet number is required to return a pickup speed of the digital office device adjusted by means of the fuzzy inference to its normal speed. A detailed description with regard to the first and second threshold output sheet numbers is set forth below.

The comparison unit 308 compares the information transferred from the counter 304 with the first threshold output or the second threshold output that is stored in the storage unit in accordance with control instructions of the control unit 300. The comparison unit 308 transfers the comparison result to the control unit 300.

The control unit 300 receives the internal temperature of the digital office device from the temperature measuring unit 302, and the information (that is, temperature and moisture) with respect to the operation environment of the digital office device from the operation environment detecting unit 310. The control unit 300 uses the received information with respect to the internal temperature and the operation environment to read out the corresponding first threshold output sheet number from the storage unit 306. In general, the value of the first threshold output sheet number is low when the received internal temperature is high. In addition, the value of the first threshold output sheet number is low when the temperature among the information with respect to the received operation environment is high, and the value of the first threshold output sheet number is high when the moisture is high.

As mentioned above, the control unit 300 uses the information with respect to the internal temperature of the digital office device and the operation environment of the digital office device to read out the first threshold output sheet number from the storage unit 306.

The control unit 300 transfers the information with respect to the first threshold output sheet number received from the storage unit 306 to the comparison unit 308, and transfers the information with respect to a continuous printing sheet number received from the counter 304 to the comparison unit 308. The control unit 300 uses the information with respect to the comparison result received from the comparison unit 308 and determines whether the pickup speed should be adjusted by means of the fuzzy inference. When the continuous printing sheet number is bigger than the first threshold output sheet number, the control unit 300 adjusts the pickup speed by means of the fuzzy inference according to an embodiment of the present invention.

The pickup speed in consideration of the fuzzy inference is determined by the temperature and the moisture transferred from the operation environment detecting unit 310. The pickup speed is decreased when the temperature transferred from the operation environment detecting unit 310 is high, and is increased when it is low. In addition, the pickup speed is increased when the moisture transferred from the operation environment detecting unit 310 is low, and is decreased when it is high. In this case, the information with respect to the temperature among the temperature and the moisture is given a priority to adjust the pickup speed. In other words, when the temperature and the moisture which are transferred from the operation environment detecting unit 310 are high, the control unit 300 gives the priority to the information with respect to the temperature among the received information to decrease the pickup speed.

The adjusted pickup speed may be classified into at least two sections based on its transferred information. The user may classify the pickup speed in detail in order to enhance the reliability of the digital office device.

The control unit 300 transfers the information with respect to the printing sheet number resulted from the image formation using the adjusted pickup speed to the comparison unit 308. The control unit 300 transfers the information with respect to the second threshold output sheet number stored in the storage unit 306 to the comparison unit 308. The control unit 300 receives the comparison result of the information with respect to the second threshold output sheet number and the printing sheet number resulted from the image formation using the adjusted pickup speed, which are transferred from the comparison unit, and determines whether the adjusted pickup speed should be returned to its normal pickup speed.

In FIG. 3, the comparison unit 308 and the control unit 300 are discriminated, however, they may be formed as one unit by the setting of the user if necessary. In other words, the control unit 300 may perform comparison between the information transferred from the counter 304 and the information read out from the storage unit 306.

Figure 4:
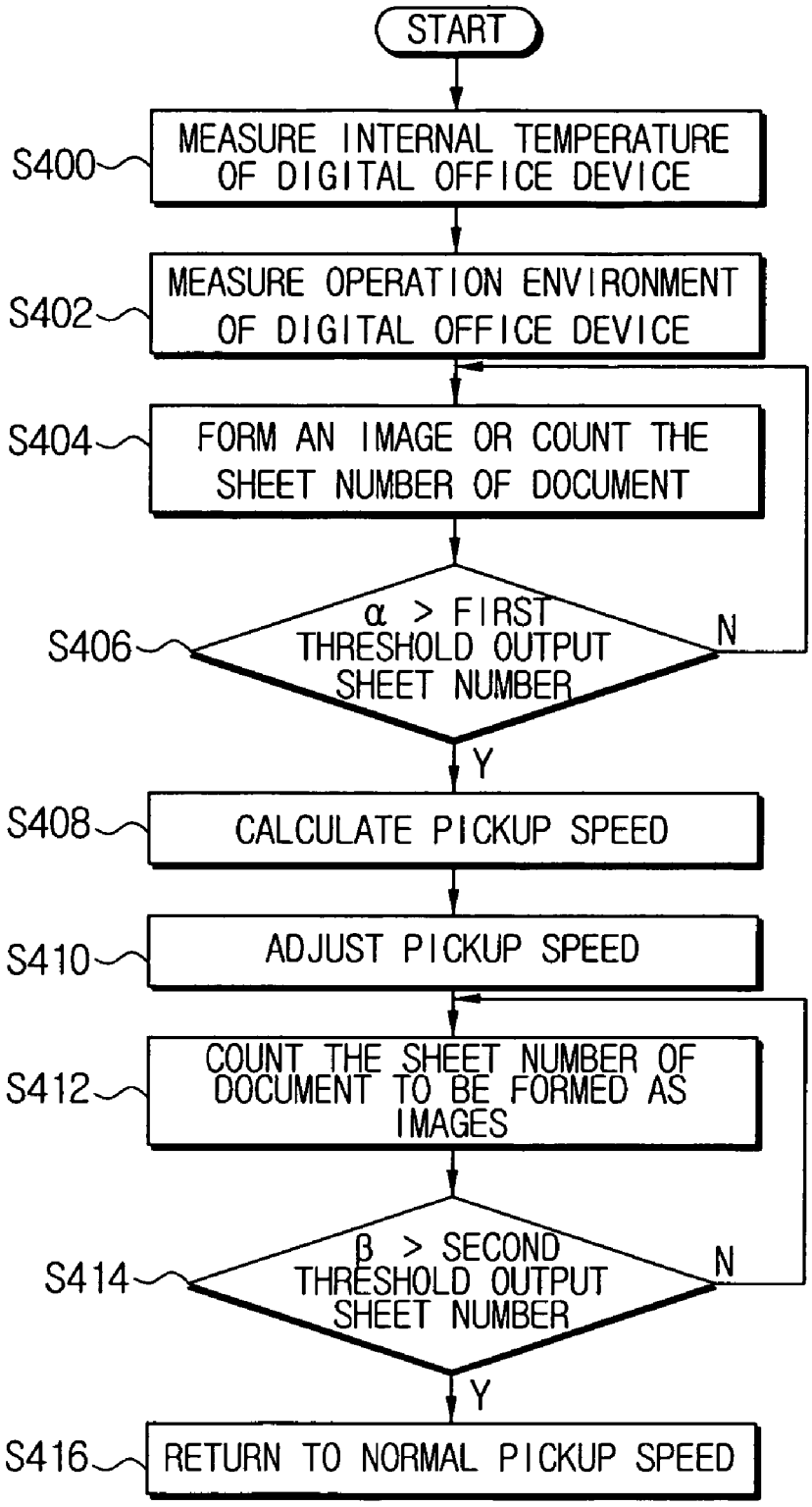
FIG. 4 is a flowchart of operations performed in a digital office device according to an embodiment of the present invention.

Referring to FIG. 4, the following is a detailed description of the operations performed in the digital office device according to an embodiment of the present invention.

In a step S400, the temperature measuring unit 302 of the digital office device measures the internal temperature of the digital office device. The temperature measuring unit 302 measures the internal temperature when it receives an instruction from an external device to perform the image formation on the printing data or receives an instruction from an input unit constituting a portion of the digital office device to perform the image formation on the printing data stored in the digital office device.

In a step S402, the operation environment detecting unit 310 of the digital office device detects the operation environment of the digital office device. As mentioned above, the operation environment detecting unit 310 detects the temperature and the moisture. The steps S400 and S402 may be performed as one step based on the setting of the user if necessary. The control unit 300 of the digital office unit uses the information measured in the steps S400 and S402 to read out the first threshold output sheet number from the storage unit 306.

In a step S404, the digital office device performs the image formation, and counts the sheet number of a document to be formed as images. The sheet number of the document to be formed as images is counted in real-time and then transferred to the comparison unit 308.

In a step S406, the comparison unit 308 of the digital office device compares the sheet number to be continuously printed that is transferred from the counter 304 with the first threshold output sheet number. The digital office device proceeds to the step S404 when the output sheet number transferred from the counter 308 is smaller than the first threshold output sheet number upon the comparison. The digital office device proceeds to a step S408 when the output sheet number transferred from the counter 308 is bigger the first threshold output sheet number upon the comparison.

In a step S408, the digital office device calculates the pickup speed using the fuzzy inference. The information with respect to the operation environment of the digital office device measured in the step S402 is used for the calculation of the pickup speed using the fuzzy inference. As mentioned above, the digital office device gives the priority to the temperature information over the moisture information to calculate the pickup speed.

In a step S410, the digital office device adjusts the pickup speed so as to form the image at the pickup speed measured in the step S408.

In a step S412, the counter 304 of the digital office device counts the sheet number of a document to be printed after the pickup speed is adjusted. In a step S414, the digital office device compares the sheet number of the document to be printed after the pickup speed is adjusted with the second threshold output sheet number. The second threshold output sheet number may be adjusted by the setting of the user. In other words, the more the second threshold output sheet number increases, the more the internal temperature change of the digital office device becomes, and the less the second threshold output sheet number decreases, the less the internal temperature change of the digital office device becomes. However, when the second threshold output sheet number is small, the number of time for calculating the pickup speed by means of the fuzzy inference may be increased. Accordingly, the user sets the second threshold output sheet number in consideration of the operation environment, the number of time for calculating the pickup speed, and so forth.

The digital office device proceeds to the step S412 when the sheet number of the document to be printed after the pickup speed is adjusted is smaller than the second threshold output sheet number upon the comparison. The digital office device continues to the step S416 when the sheet number of the document to be printed after the pickup speed is adjusted is bigger than the second threshold output sheet number upon the comparison. In the step S416, the digital office device returns the adjusted pickup speed to its initial normal pickup speed.

It is shown that the digital office device returns to its normal pickup speed in the step S416, however, the speed may be alternatively implemented based on the setting of the user. In other words, the internal temperature of the digital office device is transferred from the temperature measuring unit in the step S416, and it is determined whether the transferred internal temperature of the digital office device is within an internal temperature range that is predetermined for the optimal digital office device performing the image formation.

The digital office device returns to its normal pickup speed when the transferred internal temperature of the digital office device is within the internal temperature range of the optimal digital office device upon the determination. The digital office device may calculate the pickup speed again when the transferred internal temperature of the digital office device exceeds the internal temperature range of the optimal digital office device upon the determination. In other words, the pickup speed is increased when the transferred internal temperature of the digital office device is lower than that of the optimal digital office device. In addition, the pickup speed is decreased when the transferred internal temperature of the digital office device is higher than that of the optimal digital office device.

Figure 5:
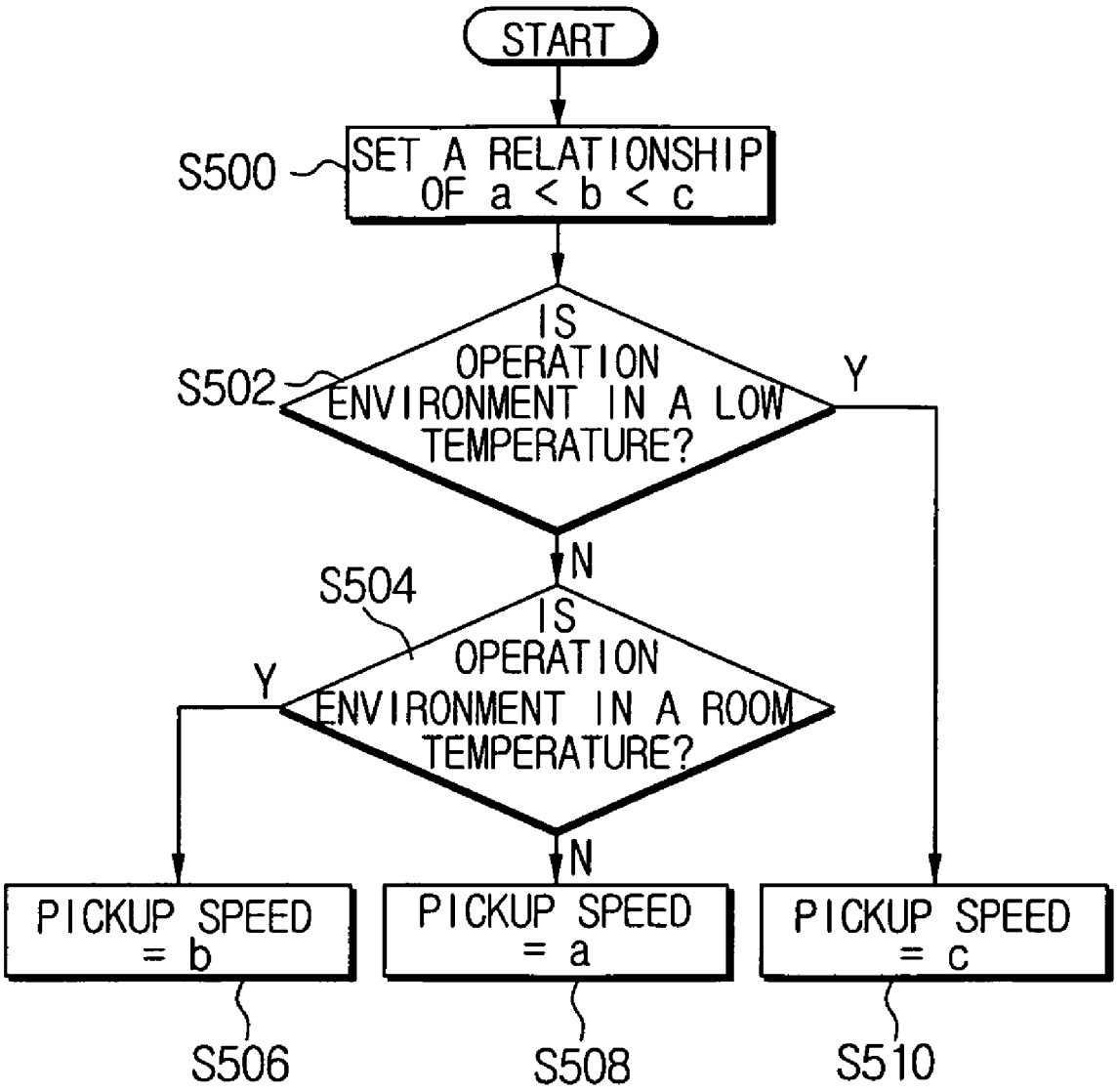
FIG. 5 is a flowchart of operations performed in a digital office device according to an embodiment of the present invention.

FIG. 5 is a flowchart of operations performed in a digital office device in accordance with the operation environment. FIG. 5 illustrates an example of using only the temperature information among the temperature and moisture information transferred from the operation environment detecting unit 310 to calculate the pickup speed. In addition, it is assumed that the digital office device has classified the temperature that may be detected from the operation environment detecting unit 310 into three sections.

In a step S500, the digital office device sets values of a, b, and c, where b is set to be bigger than a and smaller than c. In a step S502, the digital office device determines whether the operation environment is in a low temperature section. It proceeds to a step S510 when the operation environment is in the low temperature section upon determination. It proceeds to a step S504 when the operation environment is not in the low temperature section upon the determination.

In the step S504, the digital office device determines whether the operation environment is in a room temperature section. It proceeds to a step S506 when the operation environment is in the room temperature section upon the determination, and proceeds to a step S508 when the operation environment is not in the room temperature section upon the determination.

The digital office device adjusts the pickup speed to b in the step S506, adjusts it to a in the step S508, and adjusts it to c in the step S510.

The digital office device performs the image formation on the printing data using the adjusted pickup speed. In addition, an operating speed of an engine may be adjusted in addition to the pickup speed to thereby adjust the internal temperature of the printer. FIG. 5 illustrates that the pickup speed to be adjusted is already preset, however, the digital office device may calculate the pickup speed to be adjusted using the operation environment and the fuzzy inference. That is, the control unit 300 of the digital office device implements the fuzzy modeling function with respect to the internal temperature change resulted from the number of continuously increased printing sheets per operation environment.

FIGS. 3 through 5 illustrate the case of the printer, however, which may be equally applied to other devices for performing the image formation. By way of example, a copy machine for performing a copy function may adjust a feeding speed to thereby adjust the internal temperature of the copy machine.

FIGS. 3 through 5 illustrate the case of the digital office device for performing only one function. However, there have been needs for developing a multi-function digital office device capable of performing several functions instead of the digital office device for performing only one function as described above with reference to FIG. 2. Accordingly, the multi-function digital office devices have been developed. Hereinafter, a description will be made on the multi-function digital office device.

The operation performed on the multi-function digital office device is analogous to that performed on the digital office device. However, the multi-function digital office device as mentioned above performs at least two functions, and a technique for managing each function with one operation is added.

Hereinafter, an operation of the multi-function digital office device will be described with reference to FIG. 4. However, a description of the operation for performing the same operation as that in the digital office device will be omitted when the multi-function digital office device is explained.

In the step S404, the multi-function digital office device counts the number of the document printing sheet to be formed as images. In this case, a weighted value with respect to the number of the printing sheet varies in response to the function to be performed on each multi-function digital office device. In other words, the weighted value is set in consideration of a relationship between the image formation and the internal temperature increase in accordance with each function. The table 1 below represents an example of weighted values set in accordance with each function.

TABLE 1

| Function | Weighted value |
|---|---|
| Printing function | $\alpha$ |
| Facsimile function | $\beta$ |
| Copy function | $\delta$ |
| Scanning function | $\epsilon$ |

Table 1 shows that weighted values are set different from one another per each function. When one printing sheet is formed as an image to have a high rate of the internal temperature increase in performing a certain function, this function is then set with a big weighted value, when one printing sheet is formed as an image to have a low rate of the internal temperature increase in performing a certain function, the function is then set with a small weighted value. Accordingly, the multi-function digital office device uses the weighted value in response to each function when the number of printing sheets to be formed as images is counted.

In the step S408, the multi-function digital office device may calculate not only the pickup speed but also the feeding speed. The feeding speed of the copy unit may be adjusted to thereby adjust the internal temperature of the digital office device. In addition, the multi-function digital office device may adjust the internal temperature of the digital office device by means of at least two methods. In addition, the temperature property change with respect to the amount of continuous printing may be considered by means of the fuzzy inference function to thereby adjust the internal temperature when at least two tasks are continuously performed.

As mentioned above, the image formation speed of the copy sheet may be adjusted in response to the internal temperature of the digital office device to thereby enhance the reliability of the product according to an embodiment of the present invention. Furthermore, various operations performed on the multi-function digital office device may be managed with one operation to thereby enhance the reliability and the stability of the system.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations which are within the spirit and scope of the present invention will be apparent to those skilled in the art.

What is claimed is:

1. A method for adjusting an image formation speed in a digital office device, the method comprising:

measuring an internal temperature and an operation environment of a digital office device;

calculating a first threshold output sheet number based on the measured internal temperature and the measured operation environment; and adjusting an image formation speed of the digital office device based on the operation environment when a sheet number of the image formation exceeds the first threshold output sheet number.

2. The method as claimed in claim 1, wherein the adjusting of the image formation speed comprises using a pickup speed of a printing sheet.

3. The method as claimed in claim 1, further comprising:

calculating a second threshold output sheet number at the adjusted image formation speed; and forming the sheet number with images at the image formation speed before the image formation speed is adjusted when the sheet number formed as images at the adjusted image formation speed exceeds the second threshold output sheet number.

4. The method as claimed in claim 1, wherein the operation environment comprises an external temperature and a moisture.

5. The method as claimed in claim 4, wherein the first threshold output sheet number is decreased when the measured internal or external temperature is high.

6. The method as claimed in claim 4, wherein the image formation speed is decreased when the measured external temperature is high or the moisture is high.

7. The method as claimed in claim 1, wherein:

the image formation comprises forming at least one first image by a first function and forming at least one second image by a second function; and adjusting the image formation speed comprises adjusting the image formation speed based on a sum of images formed by the first and second functions.

8. The method as claimed in claim 7, further comprising:

measuring a temperature increase rate;

allocating at least one weighted value to the images formed by the respective first and second operations in proportion to the measured temperature increase rate; and calculating the sum of images to be formed based on the at least one allocated weighted value.

9. The method as claimed in claim 7, wherein adjusting the image formation speed comprises adjusting the image formation speed based on a feeding speed when one of the first and second functions comprises a copy function.

10. An apparatus for adjusting an image formation speed in a digital office device, comprising:

a temperature measuring unit configured to measures an internal temperature of a digital office device;

an operation environment detecting unit configured to measure an operation environment of the digital office device; and a control unit configured to read out a first threshold output sheet number corresponding to a measurement of the internal temperature and the operation environment, the control unit adjusting the image formation speed based on the operation environment when a sheet number of image formation exceeds the first threshold output sheet number.

11. The apparatus as claimed in claim 10, wherein the adjusting the image formation speed comprises adjusting using a pick up speed of a printing sheet.

12. The apparatus as claimed in claim 10, wherein the control unit is further configured to calculate a second threshold output sheet number at the adjusted image formation speed, and to calculate the sheet number with images at the image formation speed before the image formation speed is adjusted when the sheet number formed as images at the adjusted image formation speed exceeds the second threshold output sheet number.

13. The apparatus as claimed in claim 10, further comprising a storage unit for storing the first threshold output sheet number.

14. The apparatus as claimed in claim 10, wherein the operation environment comprises an external temperature and a moisture.

15. The apparatus as claimed in claim 13, wherein:

the operation environment comprises an external temperature; and the storage unit stores the first threshold output sheet number which is inversely proportional to the measured internal temperature and the external temperature.

16. The apparatus as claimed in claim 13, wherein:

the operation environment further comprises a moisture; and the control unit decreases the image formation speed when the measured external temperature is high or the moisture is high.

17. The apparatus as claimed in claim 10, wherein:

the image formation comprises forming at least one first image by a first function and forming at least one second image by a second function; and the adjusting the image formation speed comprises adjusting the image formation speed based on a sum of images formed by the first and second functions.

18. The apparatus as claimed in claim 17, wherein the control unit measures a temperature increase rate, allocates at least one weighted value to the images formed by the respective first and second functions in proportion to the measured temperature increase rate, and calculates the sum of images to be formed based on the at least one allocated weighted value.

19. The apparatus as claimed in claim 17, wherein the control unit is further configured so that the adjusting the image formation speed comprises adjusting the image formation speed based on a feeding speed when one of the first and second functions comprises a copy function.

* * * * *